US006447924B1

(12) United States Patent
Bettridge

(10) Patent No.: US 6,447,924 B1
(45) Date of Patent: Sep. 10, 2002

(54) TITANIUM ARTICLE HAVING A PROTECTIVE COATING AND A METHOD OF APPLYING A PROTECTIVE COATING TO A TITANIUM ARTICLE

(75) Inventor: David F Bettridge, Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/404,295

(22) Filed: Sep. 24, 1999

(30) Foreign Application Priority Data

Oct. 7, 1998 (GB) ..... 9821748

(51) Int. Cl.[7] ..... B32B 15/04

(52) U.S. Cl. ..... 428/469; 428/433; 428/450; 428/699; 428/702; 427/376.2; 427/376.4; 427/376.6; 427/380; 427/427

(58) Field of Search ..... 428/411.1, 927, 428/428, 432, 433, 450, 457, 469, 472, 689, 699, 702

(56) References Cited

U.S. PATENT DOCUMENTS 3,956,531 A * 5/1976 Church et al. ..... 427/226
4,615,913 A * 10/1986 Jones et al. ..... 427/226
5,006,419 A * 4/1991 Grunke et al.
5,118,581 A * 6/1992 Shalaby ..... 428/433
5,785,775 A * 7/1998 Smashey et al. ..... 148/669

FOREIGN PATENT DOCUMENTS

| | | |
|---|---|---|
| GB | 805807 | 12/1958 |
| GB | 1 389 244 | 4/1975 |
| GB | 2 239 617 A | 10/1991 |
| JP | A-78023687 | 7/1978 |
| JP | A-6301196 | 9/1997 |

* cited by examiner

*Primary Examiner*—Deborah Jones
*Assistant Examiner*—Jennifer McNeil
(74) *Attorney, Agent, or Firm*—Oliff & Berridge, PLC

(57) ABSTRACT

A gamma titanium aluminide turbine blade (10) has a titanium oxide layer (20) on its outer surface. A protective coating (22) is applied to the aerofoil (12) and the platform (14) of the turbine blade (10) onto the titanium oxide layer (20). The protective coating (22) comprises a silicate glass having a chromium oxide filler. The protective coating (22) preferably comprise a boron titanate silicate glass having a chromium oxide filler. The oxide layer (20) adheres the protective coating (22) to the titanium aluminide turbine blade (10). The protective coating (22) provides oxidation and sulphidation resistance.

22 Claims, 2 Drawing Sheets

TITANIUM ARTICLE HAVING A PROTECTIVE COATING AND A METHOD OF APPLYING A PROTECTIVE COATING TO A TITANIUM ARTICLE

The present invention relates to a titanium article having a protective coating and a method of applying a protective coating to a titanium article, particularly to a titanium aluminide article having a protective coating and a method of applying a protective coating to a titanium aluminide article.

Titanium aluminide alloys have potential for use in gas turbine engines, particularly for turbine blades and turbine vanes in the low pressure turbine and compressor blades and vanes in the high pressure compressor and the combustion chamber diffuser section. The gamma titanium aluminides provide a weight reduction compared to the alloys currently used for these purposes.

However, titanium aluminide alloys and gamma titanium aluminide alloys will require environmental protective coatings, above a certain temperature, in a similar manner to conventional nickel base alloys or cobalt base alloys.

Convention environmental protective coatings for nickel base alloys and cobalt base alloys include aluminide coatings, platinum coatings, chromium coatings, MCrAlY coatings, silicide coatings, platinum modified aluminide coatings, chromium modified aluminide coatings, platinum and chromium modified aluminide coatings, silicide modified aluminide coatings, platinum and silicide modified aluminide coatings and platinum, silicide and chromium modified aluminide coatings etc. Aluminide coatings are generally applied by the well known pack aluminising, out of pack, vapour, aluminising or slurry aluminising processes. Platinum coatings are generally applied by electroplating or sputtering. Chromium coatings are generally applied by pack chromising or vapour chromising. Silicide coatings are generally applied by slurry aluminising. MCrAlY coatings are generally applied by plasma spraying or electron beam physical vapour deposition.

Thermal barrier coatings include yttria stabilised zirconia and magnesia stabilised zirconia etc. Thermal barrier coatings are generally applied by plasma spraying or electron beam physical vapour deposition.

However, these conventional protective coatings are not as adherent to titanium aluminide alloys in particular, or titanium alloys in general, as they are to nickel base alloys or cobalt base alloys. This is due, we believe, to the titanium oxide formed on the titanium aluminide or titanium alloy.

Accordingly the present invention seeks to provide a novel protective coating for a titanium article and a novel method of applying a protective coating to a titanium article.

Accordingly the present invention provides a titanium alloy article having a protective coating on the titanium alloy article, the protective coating comprising a coating of silicate glass having a chromium oxide filler.

Preferably the protective coating comprises an oxide layer on the titanium alloy article and the coating of silicate glass having the chromium oxide filler on the oxide layer.

Preferably the titanium alloy article comprises a titanium aluminide, more preferably the titanium alloy article comprises a gamma titanium aluminide.

Preferably the oxide layer comprises titanium oxide.

Preferably the protective coating comprises a boron titanate silicate glass having a chromium oxide filler.

Preferably the titanium alloy article comprises a turbine blade, a turbine vane, a compressor blade, or a compressor vane.

The present invention also provides a method of applying a protective coating to a titanium alloy article comprising depositing a coating comprising a silicate glass having a chromium oxide filler.

Preferably the method comprises forming an oxide layer on the titanium alloy article and depositing the coating comprising silicate glass having a chromium oxide filler on the oxide layer.

Preferably the titanium alloy article comprises a titanium aluminide, more preferably the titanium alloy article comprises a gamma titanium aluminide.

Preferably the oxide layer comprises titanium oxide.

Preferably the protective coating comprises a boron titanate silicate glass having a chromium oxide filler.

Preferably the titanium alloy article comprises a turbine blade, a turbine vane, a compressor blade, or a compressor vane.

Preferably the method comprises depositing the boron titanate glass and chromium oxide filler by spraying with a binder.

Preferably the method comprises drying the protective coating, heating the protective coating at 100° C. for 1 hour and heating the protective coating at 1030° C. for 10 to 20 minutes to fuse the protective coating.

The present invention will be more fully described by way of example with reference to the accompanying drawings in which.

Figure 1:
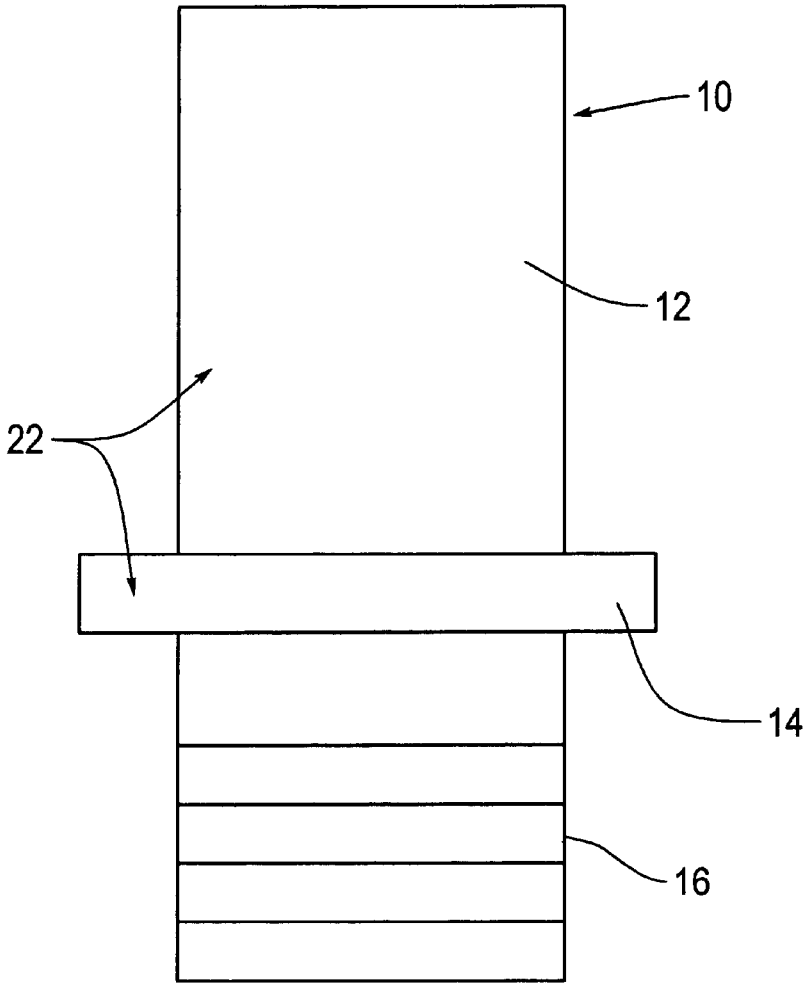
FIG. 1 shows a titanium aluminide turbine blade having a protective coating according to the present invention.

A gas turbine engine turbine blade 10, as shown in FIG. 1, comprises an aerofoil 12, a platform 14 and a root 16. The turbine blade 10 comprises a titanium aluminide, preferably gamma titanium aluminide. The turbine blade 10 has an oxide layer 20 of titanium oxide 20 on its outer surface. The aerofoil 12 and the platform 14 of the turbine blade 10 have a protective coating 22. The protective coating 22 is preferably applied to all of the aerofoil 12 and that surface of the platform 14 which contacts the gas flowing through the turbine. Alternatively the protective coating 22 may be applied only to predetermined regions of the aerofoil 12 which suffer from corrosion or oxidation.

Figure 2:
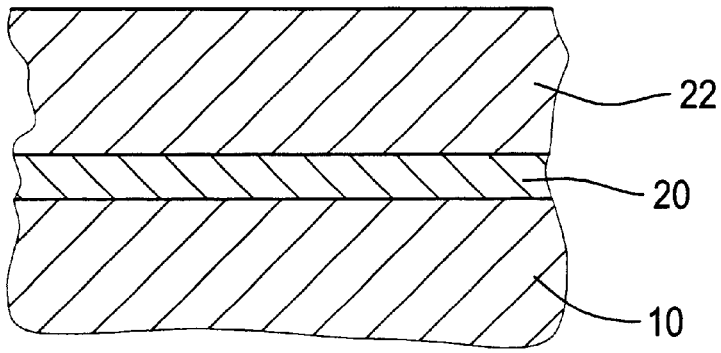
FIG. 2 is a cross-sectional view through the titanium aluminide turbine blade and protective coating according to the present invention.

The titanium aluminide turbine blade 10 and protective coating 22, are shown more clearly in FIG. 2.

The protective coating 22 comprises a silicate glass having a chromium oxide filler. The protective coating preferably comprise a boron titanate silicate glass having a chromium oxide filler.

The oxide layer 20 comprises titania, or titanium oxide. The oxide layer 20 adheres the protective coating 22 to the titanium aluminide turbine blade 10.

The silicate glass and chromium oxide filler are dispersed in a binder and distilled water. Preferably a silicate glass and chromium oxide filler frit, sold under the trade name E3765 by Cookson Matthey, Ceramics and Minerals Division of Meir, Stoke-on Trent, United Kingdom, is dispersed in a poly vinyl acetate (PVA) binder, sold under the trade name J246, and distilled water. Preferably the mixture is 632 parts by weight silicate glass and chromium oxide filler, 160 parts by weight poly vinyl acetate binder and 600 parts by weight distilled water.

The protective coating 22 is deposited onto the turbine blade 10 using conventional paint spraying equipment. The protective coating 22 is then dried in air, heated up to a temperature of 100° C. and maintained at 100° C. for 1 hour. The protective coating 22 is then heated up to a temperature of 1030° C. and maintained at that temperature for 10 to 20 minutes to fuse the protective coating 22.

It is believed that the titanium oxide layer 20 forms between the titanium alloy article 10 and the protective coating 22 during the heat treatment of the protective coating 22 or has already formed on the titanium alloy article 10. The titanium oxide 20 may form by direct oxidation of the titanium alloy article 10 during the heat treatment or may form by reaction between the protective coating 22 and the titanium alloy article 10.

The protective coating 22 provides protection against high temperature turbine environments, i.e. material loss or degradation due to oxidation and or sulphate attack at temperatures of about 700° C. and above.

In a series of burner rig tests the sulphidation resistance of different coatings applied to a gamma titanium aluminide samples and an uncoated gamma titanium samples was assessed. The burner rig used a 1% sulphur fuel with injection of artificial sea water for the first 10 hours of a 20 hour cycle after which the samples were removed for weighing. Some of the samples were coated with an MCrAlY coating, and some of the coatings were coated with the protective coating of the present invention. The burner rig testing was at 800° C. using a low velocity rig.

Figure 3:
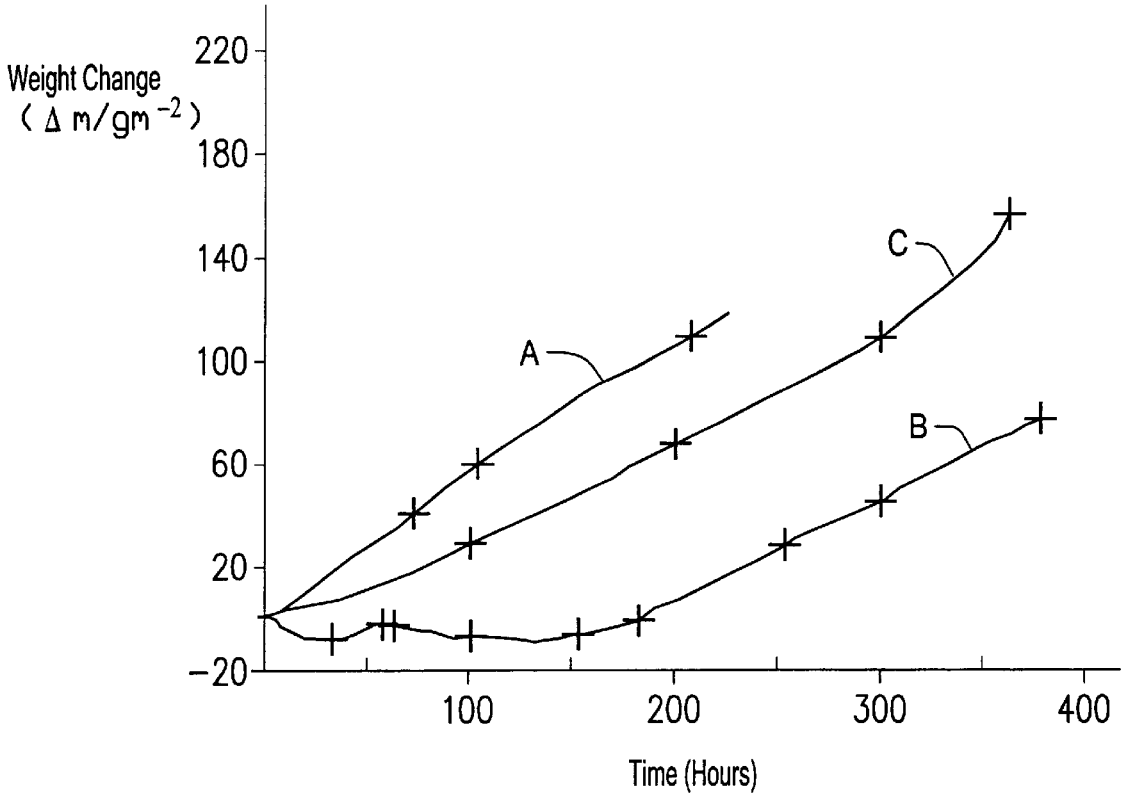
FIG. 3 is a graph showing mass change for coated and uncoated samples of gamma titanium aluminide after exposure in a burner rig at 800° C.

The mass gain data for the coated samples and uncoated samples during early stages of the test is shown in FIG. 3. Line A indicates the mass gain for the uncoated gamma titanium aluminide sample. Line B indicates the mass gain for the MCrAlY coated gamma titanium aluminide sample. Line C indicates the protective coating of the present invention. The MCrAlY coating suffered from spalling. Aluminising and MCrAlY coatings deposited by PVD did not provide significant protection.

The protective coating of the present invention provides very effective protection for the gamma titanium aluminide article. The protective coating of the present invention has the advantages of being relatively cheap and relatively easy to apply compared to conventional coatings.

I claim:

1. A titanium alloy article having a protective coating on the titanium alloy article, the protective coating comprising a coating of silicate glass having a chromium oxide filler.

2. A titanium alloy article as claimed in claim 1 wherein the protective coating comprises an oxide layer on the titanium alloy article and the coating of silicate glass having the chromium oxide filler on the oxide layer.

3. A titanium alloy article as claimed in claim 1 wherein the titanium alloy comprises a titanium aluminide.

4. A titanium alloy article as claimed in claim 3 wherein the titanium alloy article comprises a gamma titanium aluminide.

5. A titanium alloy article as claimed in claim 1 wherein the titanium alloy article is selected from the group comprising a turbine blade, a turbine vane, a compressor blade, and a compressor vane.

6. A titanium alloy article as claimed in claim 1 wherein the protective coating is formed by depositing a mixture comprised of the silicate glass and chromium oxide filler on the titanium alloy article.

7. A titanium alloy article as claimed in claim 6 wherein the mixture is deposited on the titanium alloy article by spraying.

8. A method of applying a protective coating to a titanium alloy article, comprising:

depositing a protective coating comprising a silicate glass having a chromium oxide filler on a titanium alloy article.

9. A method as claimed in claim 8 comprising forming an oxide layer on the titanium alloy article and depositing the coating comprising silicate glass having a chromium oxide filler on the oxide layer.

10. A method as claimed in claim 8 wherein the oxide layer comprises titanium oxide.

11. A method as claimed in claim 8 wherein the titanium alloy article comprises a titanium aluminide.

12. A method as claimed in claim 11 wherein the titanium alloy article comprises a gamma titanium aluminide.

13. A method as claimed in claim 8 wherein the protective coating comprises a boron titanate silicate glass having a chromium oxide filler.

14. A method as claimed in claim 8 wherein the titanium alloy article is selected from the group comprising a turbine blade, a turbine vane, a compressor blade, or a compressor vane.

15. A method as claimed in claim 8 wherein the method comprises depositing the boron titanate glass and chromium oxide filler by spraying with a binder.

16. A method as claimed in claim 8 wherein the method comprises drying the protective coating, heating the protective coating at 100° C. for 1 hour and heating the protective coating at 1030° C. for 10 to 20 minutes to fuse the protective coating.

17. A titanium alloy article having a protective coating on the titanium alloy article, the protective coating comprising a boron titanate silicate glass having a chromium oxide filler.

18. A titanium alloy article as claimed in claim 17 wherein the protective coating is formed by depositing a mixture comprised of the boron titanate silicate glass and chromium oxide filler on the titanium alloy article.

19. A titanium alloy article as claimed in claim 18 wherein the mixture is deposited on the titanium alloy article by spraying.

20. A titanium alloy article having a protective coating on the titanium alloy article, the protecting coating comprising:

an oxide layer comprising titanium oxide on the titanium alloy article; and a coating of silicate glass having a chromium oxide filler on the oxide layer.

21. A titanium alloy article as claimed in claim 20 wherein the protective coating is formed by depositing a mixture comprised of the silicate glass and chromium oxide filler on the oxide layer.

22. A titanium alloy article as claimed in claim 21 wherein the mixture is deposited on the oxide layer by spraying.

* * * * *